US006071679A

United States Patent [19]

Sigemori et al.

[11] Patent Number: 6,071,679

[45] Date of Patent: Jun. 6, 2000

[54] COLOR DEVELOPING AGENT COMPOSITION AND METHOD OF PROCESSING SILVER HALIDE COLOR PHOTOGRAPHIC MATERIAL USING SAID COMPOSITION

[76] Inventors: Nobuki Sigemori, 1305 Kashiwa, Kashiwa City, Chiba Prefecture; Masako Sekiya, 6-12 Nakamachi, Koshigaya City, Saitama Prefecture, both of Japan

[21] Appl. No.: 09/145,006

[22] Filed: Sep. 1, 1998

Related U.S. Application Data

[63] Continuation of application No. 08/807,072, Feb. 27, 1997.

[30] Foreign Application Priority Data

| | | | |
|---|---|---|---|
| Feb. 29, 1996 | [JP] | Japan | 8-69330 |
| Jun. 28, 1996 | [JP] | Japan | 8-188645 |
| Jun. 28, 1996 | [JP] | Japan | 8-188646 |
| Jul. 4, 1996 | [JP] | Japan | 8-194003 |

[51] Int. Cl.[7] ..... G03C 7/413

[52] U.S. Cl. ..... 430/486; 430/467; 430/490

[58] Field of Search ..... 430/467, 486, 430/490

[56] References Cited

U.S. PATENT DOCUMENTS

| | | | |
|---|---|---|---|
| 4,937,178 | 6/1990 | Koboshi et al. | 430/467 |
| 5,354,646 | 10/1994 | Kobayashi et al. | 430/490 |

*Primary Examiner*—Hoa Van Le
*Attorney, Agent, or Firm*—Oldham & Oldham Co., LPA

[57] ABSTRACT

As it has been described above, a color developing agent composition according to the invention, which includes a compound given by Formula (I)

(I)

wherein $R_1$ through $R_6$ are substituents respectively and independently are selected from the group consisting of a hydrogen atom or any substituted or unsubstituted group selected from among an alkyl group, an alkoxyl group, a hydroxyl group and an amino group, possible substitution groups for the selected group comprising a hydroxyl group, an amino group and an alkoxyl group; (2) a paraphenylene diamine type color developing agent; and (3) a compound given by Formula (II)

(II)

wherein $R_7$ and $R_8$ are substituents respectively and independently selected from the group consisting of a hydrogen atom or a substituted or an unsubstituted alkyl group.

10 Claims, No Drawings

COLOR DEVELOPING AGENT COMPOSITION AND METHOD OF PROCESSING SILVER HALIDE COLOR PHOTOGRAPHIC MATERIAL USING SAID COMPOSITION

CROSS REFERENCE TO RELATED APPLICATION

This application is a continuation of applicants' co-pending U.S. application Ser. No. 08/807,072, filed Feb. 27, 1997.

TECHNICAL FIELD

This invention relates to a composition used for processing silver halide color photographic material. More particularly, the invention relates a composition in the form of a liquid and a composition in the form of a solid of a paraphenylene diamine type color developing agent, said color developing agent including hydroxyl amines, which are highly stable substances. The invention also relates a method of processing silver halide color photographic material using color developer solution containing such a liquid or solid composition.

BACKGROUND OF THE INVENTION

Among the basic processes of processing silver halide color photographic material that are effected after exposure of the photographic material to a light image, are those of color developing, silver bleaching, silver halide fixing, bleaching fixing, in which a bleaching process and a fixing process are effected at a time, water washing, rinsing which is effected in lieu of the water washing process, stabilizing and drying. In addition, there are additional processes, which are executed to permit each process solution to be used stably or to increase the physical strength and stability of the processed photographic material.

Among methods of processing silver halide color photographic materials are those of processing color negative films to obtain color prints, which are the methods most widely used today, and those for directly obtaining final images in the form of positive color films or prints. Further, users of color prints want to see the prints as soon as possible and desire the production of prints in as short a period of time as possible. To meet this demand, it is necessary to provide quick processing.

In recent years, it is possible to quickly process silver halide color photographic materials owing to improvements therein. In addition, easy processing of a large quantity of materials is possible with automatic developing apparatus. Further, the automatic developing apparatus has been improved, and a variety of compact and inexpensive apparatuses have been developed. Today, numerous such automatic developing apparatuses are used. In order to obtain a large quantity of photographs easily and quickly, an automatic developing apparatus is normally used for carrying out the above photographic process. In actual processing of a large quantity of photographic materials, the process of a given quantity of photographic material is carried out while replenishing with a necessary quantity of process solution as replenishment solution. A photographic material processor who accepts a request to process photographic material from a photographer has to effect the desired process in a short period of time.

In order to process a silver halide color photographic material easily and quickly, agents necessary for the processing are available on the market in the form of a liquid so that they can be used as processing solutions by simply diluting with water. Processing of a silver halide color photographic material comprises various processes, including color developing, silver bleaching, silver halide fixing, water washing, rinsing, stabilizing and so forth, and some of these processing steps are divided into a plurality of parts, for which numerous solution parts have to be supplied. The most important step in processing a silver halide color photographic material is color developing, wherein a color developing agent oxidized by a silver halide that has been exposed to light reacts with coupler contained in the photographic material, thereby generating a pigment image. Color developer solution supplied for this step is normally separated in three or more parts. The reason for this separation into a plurality of parts is to prevent the quality of the developer from deteriorating even in cases where there may be a long interval between the time the developer was produced and actually used and also to ensure that composition of each solution part is such that it does not present any problem when mixed with other solutions.

In actual practice, color developer solution is supplied separately in three or more parts, which includes a part containing a paraphenylene diamine type color developing agent to be oxidized by silver halide exposed to light and then, reacting with coupler contained in the photographic material, generate a pigment image; a part containing a hydroxylamine type compound to improve stability of the color developer solution; and a part or parts containing a substance to keep the color developer solution alkaline and any other necessary substances. Among these parts, if supplied as a liquid, a paraphenylene diamine type color developing agent has to be stable even when subjected to various storage conditions. As a paraphenylene diamine type color developing agent tends to be oxidized in storage, it is normally prepared as aqueous solution with sulfurous compound being added to prevent oxidation of the agent. Examples of methods for improving stability of compositions of color developing agents supplied in the form of aqueous solution are shown in Japanese Patent Publication No. 37957/1970, like Publication No. 24050/1973, Japanese Patent Application Public Disclosure No. 136045/1988, like Disclosure No. 181245/1993 and U.S. Pat. Nos. 3,615,572, 3,647,461 and 3,647,462. All of the aforementioned, however, call for using sulfurous acid and therefore present a problem in that sulfur dioxide is generated. If supplied as liquid, a hydroxylamine type compound, too, has to be stable even when subjected to various storage conditions. Therefore, it is supplied in the form of aqueous solution which is solely comprised of the hydroxylamine type compound and water.

As described above, in conventional practice, color developer solution used for processing silver halide color photographic material is supplied separately in three or more solution parts in order to maintain the quality of each respective composition. In other words, only the present invention has succeeded in providing the compositions that constitute color developer solution in two solution parts by combining a paraphenylene diamine type color developing agent and a hydroxylamine type compound into a single solution part. The present invention is also the first to provide a paraphenylene diamine type color developing agent and a hydroxylamine type compound in a solid state, which the present invention offers hereby.

As color developer solution used for processing silver halide color photographic material is the key composition in photographic processing and its stability is especially important, the solution is conventionally provided in a plurality of solution parts (parts) in order to increase the stability in storage. The processing thus requires numerous solution parts (parts), resulting in inconvenient handling as well as an increased quantity of waste after use. Therefore, there is a demand for a color developing agent composition which is convenient to handle, produces less waste after use and has superior stability in storage.

In order to provide a color developing agent composition which is convenient to handle, produces less waste after use and has superior stability in storage, the inventors conducted research and investigations concerning the way to supply compositions that constitute color developer solution in two parts or two solution parts, and, as a result, found that the above objective could be attained by a paraphenylene diamine type color developing agent which contains a particular compound and a hydroxylamine type compound which also contains a particular compound. The present invention is predicated in this finding.

SUMMARY OF THE INVENTION

An object of the invention, accordingly, is to provide a color developing agent composition which is convenient to handle, reduces waste after use and has superior stability in storage, said color developing agent composition comprising a paraphenylene diamine type color developing agent containing a particular compound and a hydroxylamine type compound containing a particular compound.

In processing a silver halide color photographic material, an object of the present invention is attained by a color developing agent composition which is convenient to handle, reduces waste after use and has superior stability in storage, wherein said color developing agent composition being in the state of a liquid or a solid and containing compounds specified respectively in paragraphs (1), (2) and (3) below:

(1) a compound given by Formula (I)

(I)

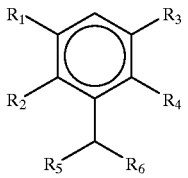

wherein $R_1$ through $R_6$ are substituents respectively and independently are selected from the group consisting of a hydrogen atom or any substituted or unsubstituted group selected from among an alkyl group, an alkoxyl group, a hydroxyl group and an amino group, possible substitution groups for the selected group comprising a hydroxyl group, an amino group and an alkoxyl group;

(2) a paraphenylene diamine type color developing agent; and (3) a compound given by Formula (II)

(II)

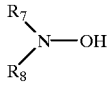

wherein $R_7$ and $R_8$ are substituents respectively and independently selected from the group consisting of a hydrogen atom or a substituted or an unsubstituted alkyl group.

Another object of the present invention is to provide a method of processing a silver halide color photographic material after said silver halide color photographic material has been exposed to a light image, the processing method using color developer solution which contains said color developing agent composition in the state of a liquid or a solid.

DETAILED DESCRIPTION OF THE INVENTION

Next, the present invention is explained in detail hereunder referring to an embodiment thereof. A solid color developing agent composition and a liquid color developing agent composition each containing compounds specified respectively in paragraphs (1), (2) or (3) below:

(1) a compound given by Formula (I)

(I)

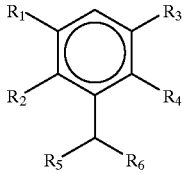

wherein $R_1$, through $R_6$ are substituents respectively and independently are selected from the group consisting of a hydrogen atom or any substituted or unsubstituted group selected from among an alkyl group, an alkoxyl group, a hydroxyl group and an amino group, possible substitution groups for the selected group comprising a hydroxyl group, an amino group and an alkoxyl group;

(2) a paraphenylene diamine type color developing agent; and (3) a compound given by Formula (II)

(II)

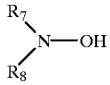

wherein $R_7$ and $R_8$, are substituents respectively and independently selected from the group consisting of a hydrogen atom or a substituted or an unsubstituted alkyl group.

The invention is also embodied in a method of processing a silver halide color photographic material after said silver halide color photographic material has been exposed to a light image, the processing method using color developer solution which contains said color developing agent composition in the state of a liquid or a solid.

At present, a large variety of silver halide photographic materials are commercially available. Depending on their purposes, they are available in different forms, for example, color negative films, color reversal films, and color printing materials, such as negative-positive printing materials and positive-positive printing materials. Among those, color negative films and positive printing materials are usually used. These many different silver halide color photographic materials have different laminar structures and their own features. There is also a tremendous variety of silver halide compositions constituting these layers; the differences in the quantities of silver chloride, silver bromide and silver iodide used, the differences in the composition ratio, particle sizes and shapes of silver halide grains and so forth provide for respective features. Furthermore, various additives including sensitivity-increasing pigments, stabilizers, intensifiers and restrainers are used. The aforementioned particle size is dealt with in, for example, Basis of Photographic Industry—Silver-Salt Photography, edited by the Society of Photographic Science and Technology of Japan and published by Corona Co., Ltd., p-p. 277–278. Further, silver halide color photographic materials use various couplers, for which numerous kinds of compounds are used. The present invention is applicable to all and any silver halide color photographic materials having compositions and components described above.

For processing a silver halide color photographic material, usually an automatic developing apparatus is used. There is a great variety of automatic developing apparatus, which are different in type, processing speed, temperature of process, process steps, method of replenishment with replenishment solutions, method of dealing with over-flow solution and so forth and have their own features. The present invention is applicable to all and any automatic developing apparatus having various structures described above.

Examples of actual compounds used for the invention are shown below without any sense of limiting the invention. Examples of compounds (1) (General Formula (I)) used for the invention are as follows:

| Cpd | Formula |
|---|---|
| I-1 | 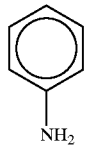 |
| I-2 | 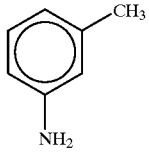 |

-continued

| Cpd | Formula |
|---|---|
| I-3 | 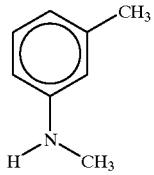 |
| I-4 | 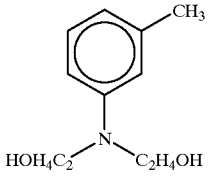 |
| I-5 | 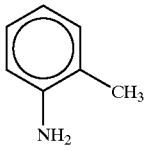 |
| I-6 | 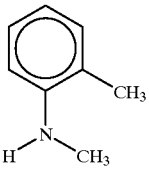 |
| I-7 | 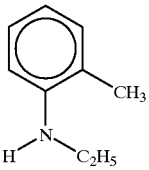 |
| I-8 | 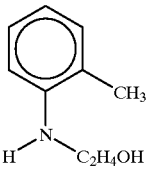 |
| I-9 | 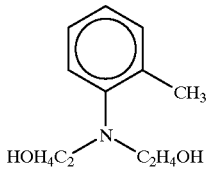 |
| I-10 | 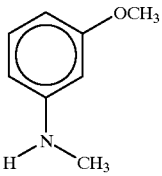 |

-continued
| Cpd | Formula |
|---|---|
| I-11 | 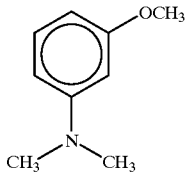 |
| I-12 | 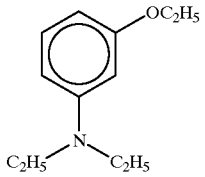 |
| I-13 | 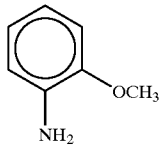 |
| I-14 | 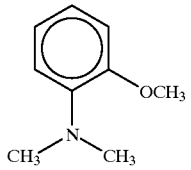 |
| I-15 | 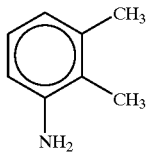 |
| I-16 | 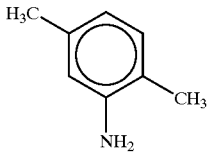 |
| I-17 | 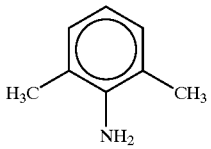 |
| I-18 | 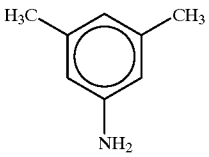 |
-continued
| Cpd | Formula |
|---|---|
| I-19 | 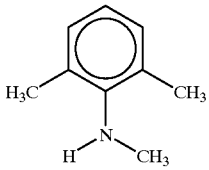 |
| I-20 | 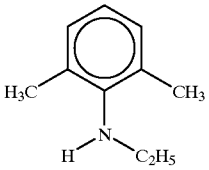 |
| I-21 | 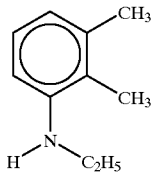 |
| I-22 | 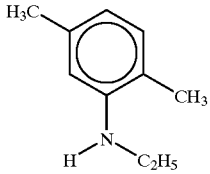 |
| I-23 | 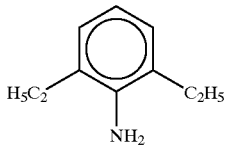 |
| I-24 | 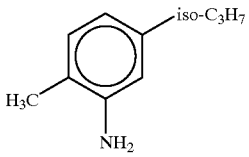 |
| I-25 | 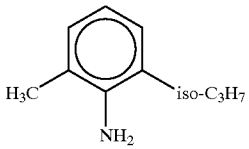 |
| I-26 | 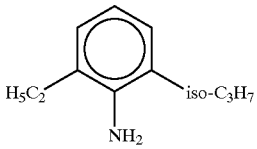 |

-continued
| Cpd | Formula |
|---|---|
| I-27 | 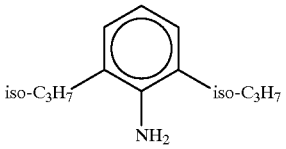 |
| I-28 | 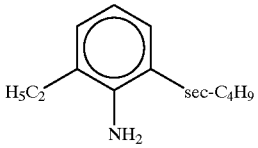 |
| I-29 | 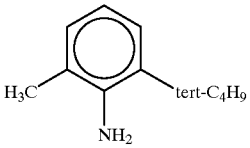 |
| I-30 | 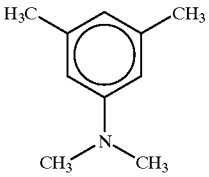 |
| I-31 | 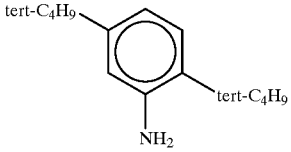 |
| I-32 | 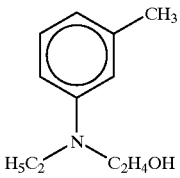 |
| I-33 | 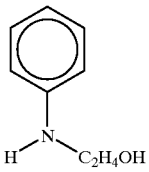 |
| I-34 | 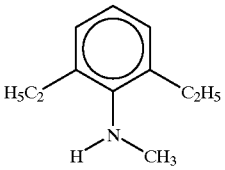 |
-continued
| Cpd | Formula |
|---|---|
| I-35 | 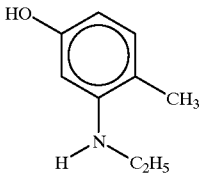 |
| I-36 | 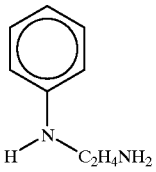 |
| I-37 | 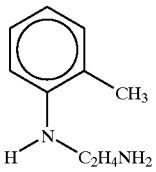 |
| I-38 | 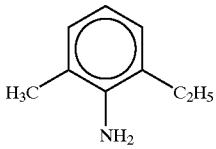 |
| I-39 | 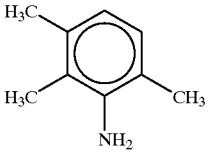 |
| I-40 | 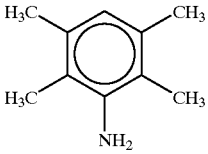 |
| I-41 | 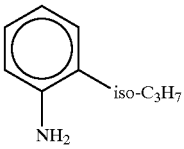 |
| I-42 | 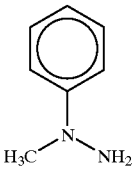 |

-continued

| Cpd | Formula |
|---|---|
| I-43 | 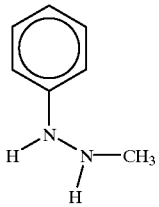 |
| I-44 | 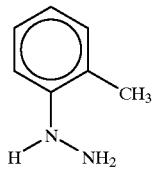 |
| I-45 | 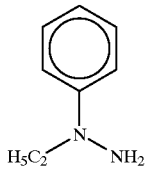 |

Examples of compounds (2) (paraphenylene diamine type color developing agents) used for the invention are as follows:

(1) 4-amino-3-methyl-N-diethyl aniline hydrochloride;

(2) 4-amino-N-ethyl-N-(-hydroxyethyl) aniline sulfate;

(3) 4-amino-3-methyl-N-ethyl-N-(-methylsulfonamide ethyl) aniline 3/2-sulfate 1-hydrate;

(4) 4-amino-3-methyl-N-ethyl-N-(-hydroxyethyl) aniline sulfate 1-hydrate;

(5) 4-amino-3-(-methylsulfonamide ethyl)-N-diethyl aniline hydrochloride;

(6) 4-amino-N-ethyl-N-(-methoxyethyl) aniline 2-paratoluene sulfonate; and (7) 4-amino-N-butyl-N-(-butylsulfonate) aniline sulfate.

Examples of compounds (3) (General Formula (II)) used for the invention are as follows:

| Cpd | Formula |
|---|---|
| II-1 | 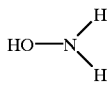 |
| II-2 | 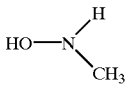 |
| II-3 | 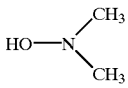 |

-continued

| Cpd | Formula |
|---|---|
| II-4 | 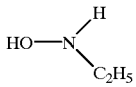 |
| II-5 | 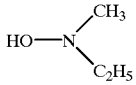 |
| II-6 | 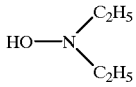 |
| II-7 | 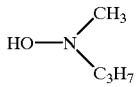 |
| II-8 | 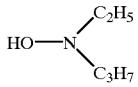 |
| II-9 | 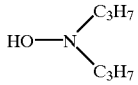 |
| II-10 | 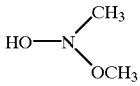 |
| II-11 | 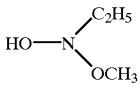 |
| II-12 | 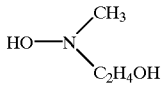 |
| II-13 | 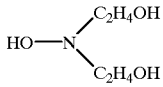 |
| II-14 | 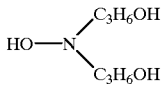 |
| II-15 | 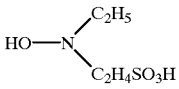 |
| II-16 | 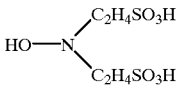 |
| II-17 | 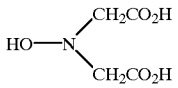 |

-continued

| Cpd | Formula |
|---|---|
| II-18 | 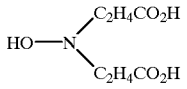 |
| II-19 | 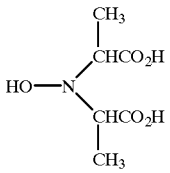 |
| II-20 | 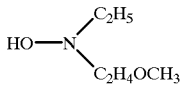 |
| II-21 | 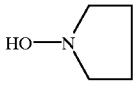 |
| II-22 | 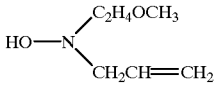 |
| II-23 | 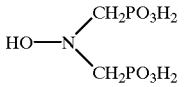 |

In addition to the above compounds, an acid or acids may be used to make a liquid color developing agent composition according to the invention acidic. Examples of acids for this purpose include hydrochloric acids, sulfuric acids, nitric acids phosphoric acids and organic acids. Various sulfites and acidic sulfites may also be used. A liquid color developing agent composition according to the invention should have a pH of less than 5, preferably less than 2.

A solid color developing agent composition according to the invention can be obtained by dissolving a compound (1) according to the invention in such an organic solvent as an aliphatic hydrocarbon, an aromatic hydrocarbon, alcohol, ketone, an ester, ether, a hydrocarbon halide, a perfluorocarbon or the like, adding a compound (2), and then mixing a compound (3) according to the invention with the above combination of the compounds from which the organic solvent used has been removed. A solid color developing agent composition according to the invention can also be obtained by dissolving a compound (1) according to the invention in water having a pH of less than 3 or solvent which consist of water having a pH of less than 3 and such an organic solvent as alcohol, ketone or the like, adding a compound (2), and then mixing a compound (3) according to the invention with the above combination of the compounds from which the water and organic solvent used have been removed. Water used for this purpose should have a pH of less than 3, or, preferably, less than 2, and an acid used for this purpose should by an inorganic acid or an organic acid, concrete examples of which include sulfuric acids, hydrochloric acids, nitric acids phosphoric acids, acetic acids, oxalic acids and paratoluene sulfonates. Examples of preferable organic solvents used for this invention are shown in "Solvent Pocketbook, New Edition" published by Ohmsha Co., Ltd.

Further, "liquid color developing agent composition" referred to in the claims and the explanation herein means color developing agent composition which is not in the state of a solid but in the state of a liquid, more specifically in the state dissolved in water or an organic solvent. In many cases, it is in the state of an aqueous solution. On the other hand, "solid color developing agent composition" referred to in the claims and the explanation herein means color developing agent composition which is not in the state of a liquid but in the state of a solid, more specifically in the state of powder, particles or a solid body or solid bodies. In many cases, it is in the state of powder or particles.

A color developing agent composition used according to the present invention may contain various usual components, examples of which include such alkali compounds as potassium hydroxide, sodium hydroxide, potassium carbonate, sodium carbonate, potassium phosphate and sodium phosphate, such sulfites, hydrosulfites and metabisulfites as sodium sulfite, potassium sulfite, sodium hydrosulfite, potassium hydrosulfite, sodium metabisulfite and potassium metabisulfite, such halides as potassium chloride, sodium chloride, potassium bromide, sodium bromide, potassium iodide and sodium iodide, such water-softening- agents as aminopolycarbonic acid, polystylene sulfonic acid and polyphosphonic acid, such thickening agents as ethylene glycol, diethylene glycol, diethanolamine and triethanolamine, and development acceleration agents. Furthermore, such compounds as nitrobenzoimidazol, mercaptobenzoimidazol, 5-methyl-benzotriazol and 1-phenyl-5-mercaptotetrazol, anti-stain agents, anti-sludge agents, optical whitening agents and so forth may be used as additives.

EXAMPLES

Next, embodiments of the present invention are explained in detail hereunder, by way of non-limiting examples only.

Example #1

Aqueous solutions respectively comprising the color developing agent compositions according to Tables 1 and 2 below were prepared and bottled in 200 ml vinyl chloride containers. Then, the containers were capped and stored in room temperature for a period of one month, and then a test was conducted to observe stability of each color developing agent composition. The color developing agent compositions used for the stability test are as follows:

Compound (1) of the invention 0.01 mol

Compound (2) of the invention 0.05 mol

Compound (3) of the invention 0.10 mol

After adding water (adjusted to pH 2 by sulfuric acid) 100 ml

TABLE 1 & 2

| Test No. | Compound (1) of the Invention | Compound (2) of the Invention | Compound (3) of the Invention | Remaining Developing Agent (%) |
|---|---|---|---|---|
| 1 | | 4-amino-N-ethyl-N-(-hydroxyethyl) aniline sulfate | 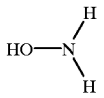 | 4% |
| 2 | 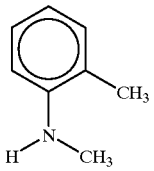 | 4-amino-N-ethyl-N-(-hydroxyethyl) aniline sulfate | 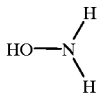 | 96% |
| 3 | | 4-amino-N-ethyl-N-(-hydroxyethyl) aniline sulfate | 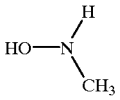 | 65% |
| 4 | 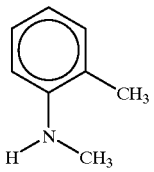 | 4-amino-N-ethyl-N-(-hydroxyethyl) aniline sulfate | 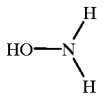 | 97% |
| 5 | | 4-amino-3-methyl-N-ethyl-N-(-methyl sulfonamide ethyl) aniline 3/2-sulfate 1-hydrate | 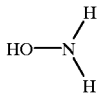 | 6% |
| 6 | 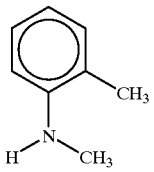 | 4-amino-3-methyl-N-ethyl-N-(-methyl sulfonamide ethyl) aniline 3/2-sulfate 1-hydrate | 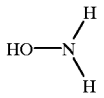 | 97% |
| 7 | 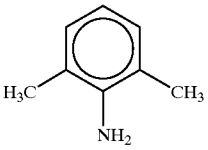 | 4-amino-3-methyl-N-ethyl-N-(-methyl sulfonamide ethyl) aniline 3/2-sulfate 1-hydrate | 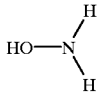 | 95% |
| 8 | 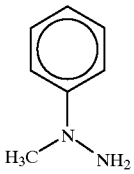 | 4-amino-3-methyl-N-ethyl-N-(-methyl sulfonamide ethyl) aniline 3/2-sulfate 1-hydrate | 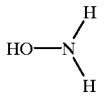 | 97% |
| 9 | | 4-amino-3-methyl-N-ethyl-N-(-hydroxy-ethyl) aniline sulfate 1-hydrate | 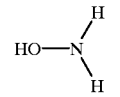 | 6% |

TABLE 1 & 2-continued

| Test No. | Compound (1) of the Invention | Compound (2) of the Invention | Compound (3) of the Invention | Remaining Developing Agent (%) |
|---|---|---|---|---|
| 10 | 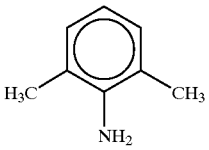 | 4-amino-3-methyl-N-ethyl-N-(-hydroxy-ethyl) aniline sulfate 1-hydrate | 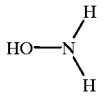 | 97% |
| 11 | 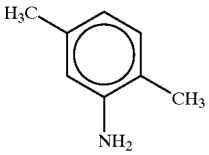 | 4-amino-3-methyl-N-ethyl-N-(-hydroxy-ethyl) aniline sulfate 1-hydrate | 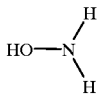 | 96% |
| 12 | | 4-amino-3-methyl-N-ethyl-N-(-methyl sulfonamide ethyl) aniline 3/2-sulfate 1-hydrate | 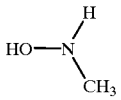 | 5% |
| 13 | 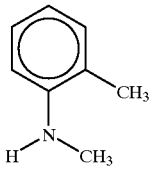 | 4-amino-3-methyl-N-ethyl-N-(-hydroxy-ethyl) aniline sulfate 1-hydrate | 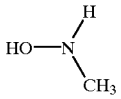 | 98% |
| 14 | 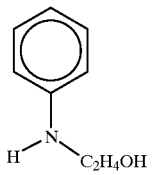 | 4-amino-3-methyl-N-ethyl-N-(-hydroxy-ethyl) aniline sulfate 1-hydrate | 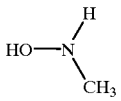 | 75% |
| 15 | 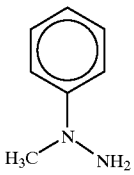 | 4-amino-3-methyl-N-ethyl-N-(-hydroxy-ethyl) aniline sulfate 1-hydrate | 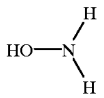 | 96% |

A liquid chromatograph was used to measure the above remaining percentages of the developing agents. Sulfate and hydrochloride were respectively used as compounds (II-1) and (II-2) of compounds (3) of the invention.

As is seen from the above results, each and every liquid color developing agent composition containing compounds (1), (2) and (3) according to the invention results in a high percentage of the color developing agent used remaining compared with a far lower percentage of the color developing agent contained in any one of the liquid color developing agent compositions that did not contain a compound (1) according to the invention. This proves that a composition of a color developing agent according to the invention has excellent stability.

Example #2

Aqueous solutions respectively comprising the color developing agent compositions according to Table 3 below were prepared and bottled in 200 ml vinyl chloride containers. Then, the containers were capped and stored in a 50° C. thermostat for 200 hours, and then a test was conducted to observe stability of each color developing agent composition. The color developing agent compositions used for the stability test are as follows:

Compound (1) of the invention 0.01 mol

Compound (2) of the invention 0.05 mol

Compound (3) of the invention 0.10 mol

After adding water (adjusted to pH 1 by sulfuric acid) 100 ml

TABLE 3

| Test No. | Compound (1) of the Invention | Compound (2) of the Invention | Compound (3) of the Invention | Remaining Developing Agent (%) |
|---|---|---|---|---|
| 16 | | 4-amino-3-methyl-N-ethyl-N-(-methyl-sulfonamide ethyl) aniline 3/2-sulfate 1-hydrate | 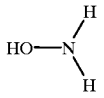 | 4% |
| 17 | 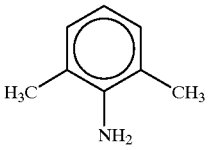 | 4-amino-3-methyl-N-ethyl-N-(-methyl-sulfonamide ethyl) aniline 3/2-sulfate 1-hydrate | 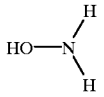 | 92% |
| 18 | | 4-amino-3-methyl-N-ethyl-N-(-methyl-sulfonamide ethyl) aniline 3/2-sulfate 1-hydrate | 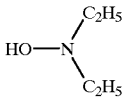 | 45% |
| 19 | 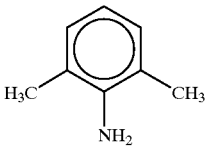 | 4-amino-3-methyl-N-ethyl-N-(-methyl-sulfonamide ethyl) aniline 3/2-sulfate 1-hydrate | 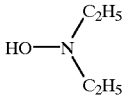 | 90% |
| 20 | 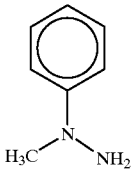 | 4-amino-3-methyl-N-ethyl-N-(-methyl-sulfonamide ethyl) aniline 3/2-sulfate 1-hydrate | 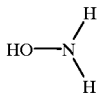 | 94% |
| 21 | | 4-amino-3-methyl-N-ethyl-N-(-hydroxy-ethyl) aniline sulfate 1-hydrate | 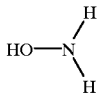 | 2% |
| 22 | 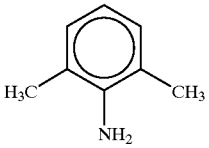 | 4-amino-3-methyl-N-ethyl-N-(-hydroxy-ethyl) aniline sulfate 1-hydrate | 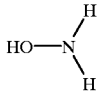 | 97% |
| 23 | 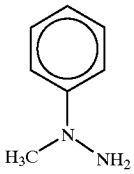 | 4-amino-3-methyl-N-ethyl-N-(-hydroxy-ethyl) aniline sulfate 1-hydrate | 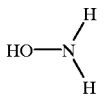 | 95% |

A liquid chromatograph was used to measure the above remaining percentages of the developing agents. Sulfate and oxalate were respectively used as compounds (II-1) and (II-6) of compounds (3) of the invention.

As is seen from the above results, each and every liquid color developing agent composition containing compounds (1), (2) and (3) according to the invention result in a high percentage of the color developing agent used remaining compared with a far lower percentage of the color developing agent contained in any one of the liquid color developing agent compositions that did not contain a compound (1) according to the invention. This proves that a composition of a color developing agent according to the invention has excellent stability.

Example #3

Each solid color developing agent composition was obtained by dissolving a compound (1) according to the invention in organic solvent, adding a compound (2) to the solution, and then mixing a compound (3) according to the invention with the above combination of the compounds from which the organic solvent used has been removed. Organic solvents and compounds (1), (2) and (3) according to the invention actually used are shown in Tables 4, 5 and 6 below. Fifteen grams (15 g) of each solid color developing agent composition obtained as above was bottled in a 100 ml container. Then, the containers were capped and stored in a 35° C. thermostat for seven days, and then, after adding 100 ml of water into each container, the transmittance of a light with a wave length of 575 nm was measured for each solution, with the result thereof shown in Table 7. The measurement was conducted by using a HITACHI Spectrophotometer U-3200 with a cell length of 10 mm.

TABLE 4, 5 and 6

| Test No. | Solvent | Compound #1 | Amt. (g) | Compound #2 | Compound #3 |
|---|---|---|---|---|---|
| 24 | | | | 4-amino-3-methyl-N-ethyl-N-(-methyl-sulfonamide ethyl) aniline 3/2-sulfate 1-hydrate | 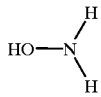 |
| 25 | | | | 4-amino-3-methyl-N-ethyl-N-(-methyl-sulfonamide ethyl) aniline 3/2-sulfate 1-hydrate | 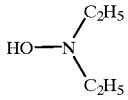 |
| 26 | | | | 4-amino-3-methyl-N-ethyl-N-(-hydroxy-ethyl) aniline sulfate 1-hydrate | 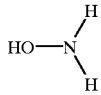 |
| 27 | | | | 4-amino-3-methyl-N-ethyl-N-(-hydroxy-ethyl) aniline sulfate 1-hydrate | 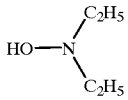 |
| 28 | petroleum ether | 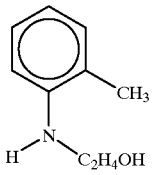 | 0.5 | 4-amino-3-methyl-N-ethyl-N-(-hydroxy-ethyl) aniline sulfate 1-hydrate | 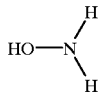 |
| 29 | petroleum ether | 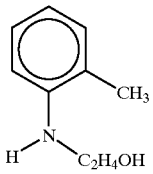 | 0.1 | 4-amino-3-methyl-N-ethyl-N-(-hydroxy-ethyl) aniline sulfate 1-hydrate | 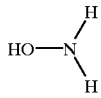 |
| 30 | petroleum ether | 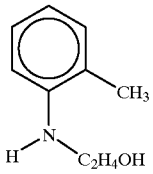 | 0.5 | 4-amino-3-methyl-N-ethyl-N-(-hydroxy-ethyl) aniline sulfate 1-hydrate | 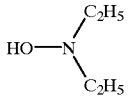 |
| 31 | petroleum ether | 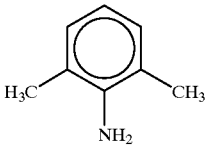 | 0.5 | 4-amino-3-methyl-N-ethyl-N-(-hydroxy-ethyl) aniline sulfate 1-hydrate | 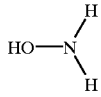 |

TABLE 4, 5 and 6-continued

| Test No. | Solvent | Compound #1 | Amt. (g) | Compound #2 | Compound #3 |
|---|---|---|---|---|---|
| 32 | benzene | 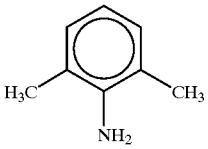 | 0.1 | 4-amino-3-methyl-N-ethyl-N-(-hydroxy-ethyl) aniline sulfate 1-hydrate | 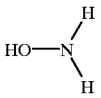 |
| 33 | benzene | 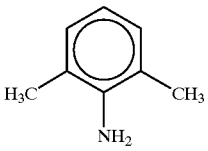 | 0.5 | 4-amino-3-methyl-N-ethyl-N-(-methyl-sulfonamide ethyl) aniline 3/2-sulfate 1-hydrate | 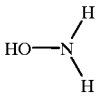 |
| 34 | benzene | 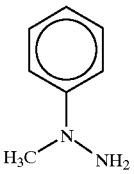 | 0.5 | 4-amino-3-methyl-N-ethyl-N-(-hydroxy-ethyl) aniline sulfate 1-hydrate | 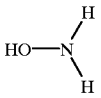 |
| 35 | methanol | 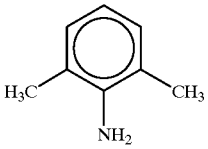 | 0.5 | 4-amino-3-methyl-N-ethyl-N-(-hydroxy-ethyl) aniline sulfate 1-hydrate | 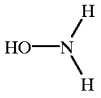 |
| 36 | methanol | 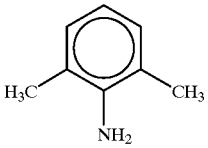 | 0.1 | 4-amino-3-methyl-N-ethyl-N-(-hydroxy-ethyl) aniline sulfate 1-hydrate | 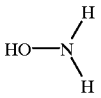 |
| 37 | methanol | 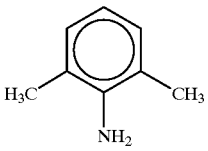 | 0.5 | 4-amino-3-methyl-N-ethyl-N-(-hydroxy-ethyl) aniline sulfate 1-hydrate | 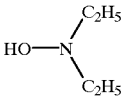 |
| 38 | acetone | 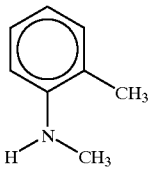 | 0.5 | 4-amino-3-methyl-N-ethyl-N-(-methyl-sulfonamide ethyl) aniline 3/2-sulfate 1-hydrate | 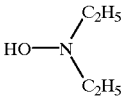 |
| 39 | acetone | 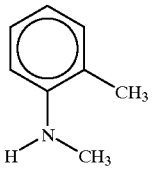 | 0.5 | 4-amino-3-methyl-N-ethyl-N-(-methyl-sulfonamide ethyl) aniline 3/2-sulfate 1-hydrate | 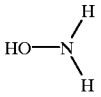 |

TABLE 4, 5 and 6-continued

| Test No. | Solvent | Compound #1 | Amt. (g) | Compound #2 | Compound #3 |
|---|---|---|---|---|---|
| 40 | acetone | 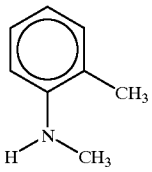 | 0.1 | 4-amino-3-methyl-N-ethyl-N-(-methyl-sulfonamide ethyl) aniline 3/2-sulfate 1-hydrate | 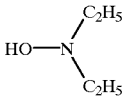 |
| 41 | ethyl acetate | 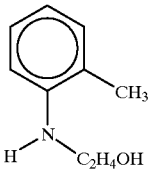 | 0.5 | 4-amino-3-methyl-N-ethyl-N-(-methyl-sulfonamide ethyl) aniline 3/2-sulfate 1-hydrate | 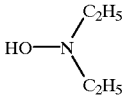 |
| 42 | ethyl acetate | 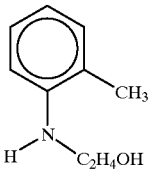 | 0.5 | 4-amino-3-methyl-N-ethyl-N-(-hydroxy-ethyl) aniline sulfate 1-hydrate | 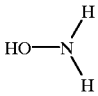 |
| 43 | diethyl ether | 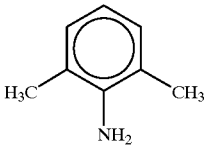 | 0.5 | 4-amino-3-methyl-N-ethyl-N-(-methyl-sulfonamide ethyl) aniline 3/2-sulfate 1-hydrate | 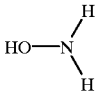 |
| 44 | diethyl ether | 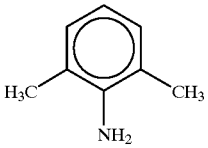 | 0.5 | 4-amino-3-methyl-N-ethyl-N-(-hydroxy-ethyl) aniline sulfate 1-hydrate | 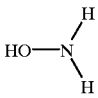 |
| 45 | 1,1-dichloro-1-fluoro-ethane | 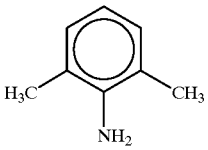 | 0.5 | 4-amino-3-methyl-N-ethyl-N-(-hydroxy-ethyl) aniline sulfate 1-hydrate | 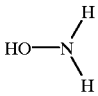 |
| 46 | 1,1-dichloro-1-fluoro-ethane | 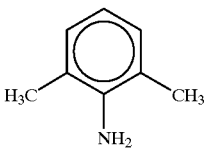 | 0.1 | 4-amino-3-methyl-N-ethyl-N-(-hydroxy-ethyl) aniline sulfate 1-hydrate | 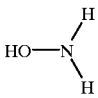 |
| 47 | 1,1-dichloro-1-fluoro-ethane | 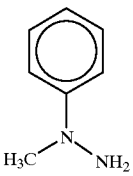 | 0.5 | 4-amino-3-methyl-N-ethyl-N-(-hydroxy-ethyl) aniline sulfate 1-hydrate | 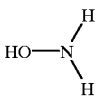 |

TABLE 4, 5 and 6-continued

| Test No. | Solvent | Compound #1 | Amt. (g) | Compound #2 | Compound #3 |
|---|---|---|---|---|---|
| 48 | 1,1-dichloro-1-fluoro-ethane | 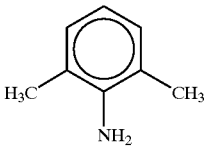 | 0.5 | 4-amino-3-methyl-N-ethyl-N-(-hydroxy-ethyl) aniline sulfate 1-hydrate | 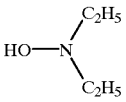 |
| 49 | 1,1-dichloro-1-fluoro-ethane | 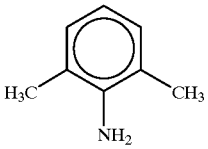 | 0.1 | 4-amino-3-methyl-N-ethyl-N-(-methyl-sulfonamide ethyl) aniline 3/2-sulfate 1-hydrate | 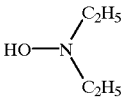 |

Quantities of compounds (2) and (3) according to the invention and organic solvent for each solution were 100 g, 50 g and 100 ml respectively. Further, sulfate and oxalate were respectively used as compounds (II-1) and (II-6) of compounds (3) of the invention.

TABLE 7

| No. | Transmittance of light of 575 nm | No. | Transmittance of light of 575 nm | No. | Transmittance of light of 575 nm |
|---|---|---|---|---|---|
| 24 | <5% | 33 | >90% | 42 | >90% |
| 25 | <5% | 34 | >90% | 43 | >90% |
| 26 | <5% | 35 | >90% | 44 | >90% |
| 27 | <5% | 36 | >90% | 45 | >90% |
| 28 | >90% | 37 | >90% | 46 | >90% |
| 29 | >90% | 38 | >90% | 47 | >90% |
| 30 | >90% | 39 | >90% | 48 | >90% |
| 31 | >90% | 40 | >90% | 49 | >90% |
| 32 | >90% | 41 | >90% | | |

As is seen from the above results in Table 7, each and every solid color developing agent composition containing compounds (1), (2) and (3) according to the invention results in a high transmittance, in other words the compositions were not tinted. On the other hand, the color developing agent compositions that did not contain a compound (1) according to the invention were tinted to a large extent, resulting in a considerably low transmittance. This proves that a composition of a color developing agent according to the invention has excellent stability.

Example #4

Each solid color developing agent composition was obtained by dissolving compounds (1) and (2) according to the invention in water which has been made acid having a pH of not more than 2 by means of sulfuric acid, and then, after removing the water, mixing a compound (3) according to the invention with the above combination of the compounds. Compounds (1), (2) and (3) according to the invention actually used are shown in Tables 8 and 9 below. Fifteen grams (15 g) of each solid color developing agent composition obtained as above was bottled in a 100 ml container. Then, the containers were capped and stored in a 35° C. thermostat for seven days, and then, measurement identical to that of Embodiment 3 above was conducted, with the result thereof shown in Table 10.

TABLES 8 and 9

| Test No. | Water pH | Compound #1 | Amt. (g) | Compound #2 | Compound #3 |
|---|---|---|---|---|---|
| 50 | 1 | | | 4-amino-3-methyl-N-ethyl-N-(-methyl-sulfonamide ethyl) aniline 3/2-sulfate 1-hydrate | 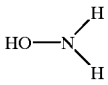 |
| 51 | 1 | | | 4-amino-3-methyl-N-ethyl-N-(-methyl-sulfonamide ethyl) aniline 3/2-sulfate 1-hydrate | 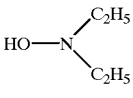 |
| 52 | 1 | | | 4-amino-3-methyl-N-ethyl-N-(-hydroxy-ethyl)aniline sulfate 1-hydrate | 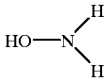 |
| 53 | 1 | | | 4-amino-3-methyl-N-ethyl-N-(-hydroxy-ethyl)aniline sulfate 1-hydrate | 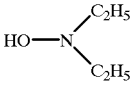 |

TABLES 8 and 9-continued

| Test No. | Water pH | Compound #1 | Amt. (g) | Compound #2 | Compound #3 |
|---|---|---|---|---|---|
| 54 | 1 | 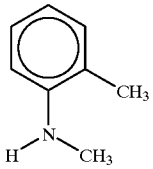 | 0.5 | 4-amino-3-methyl-N-ethyl-N-(-methyl-sulfonamide ethyl) aniline 3/2-sulfate 1 | 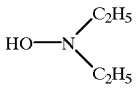 |
| 55 | 1 | 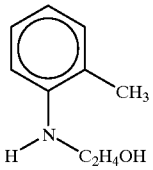 | 0.5 | 4-amino-3-methyl-N-ethyl-N-(-methyl-sulfonamide ethyl) aniline 3/2-sulfate 1 | 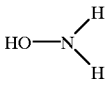 |
| 56 | 1 | 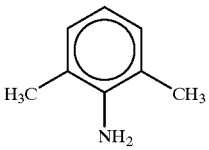 | 0.1 | 4-amino-3-methyl-N-ethyl-N-(-methyl-sulfonamide ethyl) aniline 3/2-sulfate 1 | 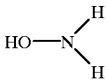 |
| 57 | 1 | 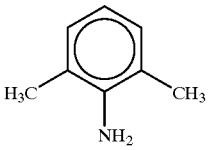 | 0.5 | 4-amino-3-methyl-N-ethyl-N-(-methyl-sulfonamide ethyl) aniline 3/2-sulfate 1 | 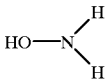 |
| 58 | 1 | 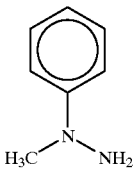 | 0.5 | 4-amino-3-methyl-N-ethyl-N-(-methyl-sulfonamide ethyl) aniline 3/2-sulfate 1 | 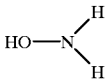 |
| 59 | 2 | 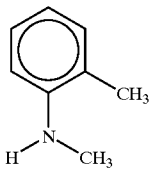 | 0.1 | 4-amino-3-methyl-N-ethyl-N-(-hydroxy-ethyl)aniline sulfate 1-hydrate | 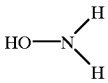 |
| 60 | 2 | 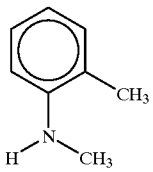 | 0.5 | 4-amino-3-methyl-N-ethyl-N-(-hydroxy-ethyl)aniline sulfate 1-hydrate | 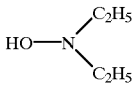 |
| 61 | 2 | 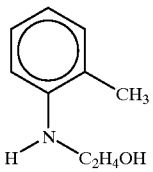 | 0.5 | 4-amino-3-methyl-N-ethyl-N-(-hydroxy-ethyl)aniline sulfate 1-hydrate | 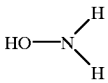 |

TABLES 8 and 9-continued

| Test No. | Water pH | Compound #1 | Amt. (g) | Compound #2 | Compound #3 |
|---|---|---|---|---|---|
| 62 | 2 | 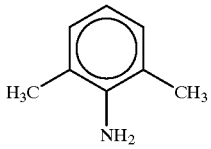 | 0.1 | 4-amino-3-methyl-N-ethyl-N-(-hydroxy-ethyl)aniline sulfate 1-hydrate | 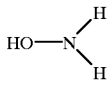 |
| 63 | 2 | 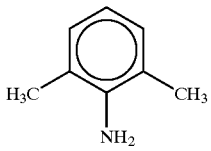 | 0.5 | 4-amino-3-methyl-N-ethyl-N-(-hydroxy-ethyl)aniline sulfate 1-hydrate | 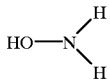 |
| 64 | 2 | 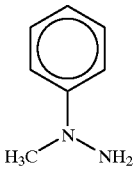 | 0.5 | 4-amino-3-methyl-N-ethyl-N-(-methyl-sulfonamide ethyl) aniline 3/2-sulfate 1 | 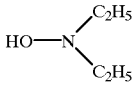 |

Quantities of compounds (2) and (3) according to the invention and organic solvent for each solution were 100 g, 50 g and 100 m respectively. Further, sulfate and oxalate were respectively used as compounds (II-1) and (II-6) of compounds (3) of the invention.

TABLE 10

| No. | Transmittance of light of 575 nm | No. | Transmittance of light of 575 nm |
|---|---|---|---|
| 50 | <5% | 58 | >90% |
| 51 | <5% | 59 | >90% |
| 52 | <5% | 60 | >90% |
| 53 | <5% | 61 | >90% |
| 54 | >90% | 62 | >90% |
| 55 | >90% | 63 | >90% |
| 56 | >90% | 64 | >90% |
| 57 | >90% | | |

As is seen from the above results in Table 10, each and every solid color developing agent composition containing compounds (1), (2) and (3) according to the invention results in a high transmittance, in other words the compositions were not tinted. On the other hand, the color developing agent compositions that did not contain a compound (1) according to the invention were tinted to a large extent, resulting in a considerably low transmittance. This proves that a composition of a color developing agent according to the invention has excellent stability.

Example #5

Each solid color developing agent composition was obtained by dissolving compounds (1) and (2) according to the invention in solution which consists of water and organic solvent, said water having been made acid pH 1 by means of sulfuric acid, and then, after removing the water and organic solvent, mixing a compound (3) according to the invention with the above combination of the compounds in the state of a solid after the removal of the water and the organic solvent. Organic solvents and compounds (1), (2) and (3) according to the invention actually used are shown in Tables 11 and 12 below. Fifteen grams (15 g) of each solid color developing agent composition obtained as above was bottled in a 100 ml container. Then, the containers were capped and stored in a 35° C. thermostat for seven days, and then, measurement identical to that of Embodiment 3 above was conducted, with the result thereof shown in Table 13.

TABLES 11 and 12

| Test No. | Solvent | Compound #1 | Amt. (g) | Compound #2 | Compound #3 |
|---|---|---|---|---|---|
| 65 | methanol | 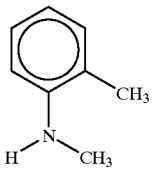 | 0.5 | 4-amino-3-methyl-N-ethyl-N-(-hydroxy-ethyl)aniline sulfate 1-hydrate | 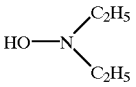 |

TABLES 11 and 12-continued

| Test No. | Solvent | Compound #1 | Amt. (g) | Compound #2 | Compound #3 |
|---|---|---|---|---|---|
| 66 | methanol | 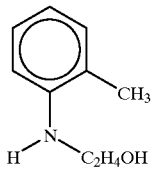 | 0.5 | 4-amino-3-methyl-N-ethyl-N-(-hydroxy-ethyl)aniline sulfate 1-hydrate | 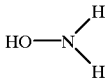 |
| 67 | methanol | 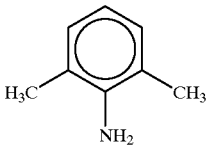 | 0.1 | 4-amino-3-methyl-N-ethyl-N-(-hydroxy-ethyl)aniline sulfate 1-hydrate | 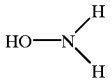 |
| 68 | methanol | 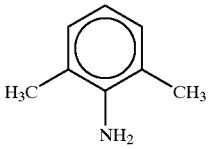 | 0.5 | 4-amino-3-methyl-N-ethyl-N-(-hydroxy-ethyl)aniline sulfate 1-hydrate | 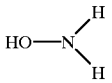 |
| 69 | methanol | 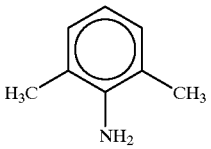 | 0.5 | 4-amino-3-methyl-N-ethyl-N-(-hydroxy-ethyl)aniline sulfate 1-hydrate | 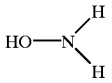 |
| 70 | methanol | 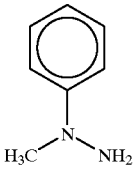 | 0.5 | 4-amino-3-methyl-N-ethyl-N-(-hydroxy-ethyl)aniline sulfate 1-hydrate | 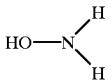 |
| 71 | acetone | 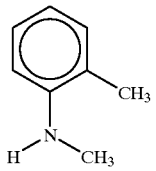 | 0.5 | 4-amino-3-methyl-N-ethyl-N-(-hydroxy-ethyl)aniline sulfate 1-hydrate | 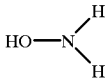 |
| 72 | acetone | 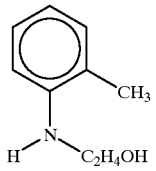 | 0.5 | 4-amino-3-methyl-N-ethyl-N-(-hydroxy-ethyl)aniline sulfate 1-hydrate | 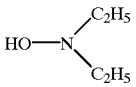 |
| 73 | acetone | 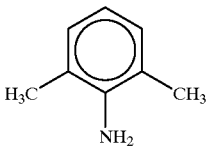 | 0.1 | 4-amino-3-methyl-N-ethyl-N-(-hydroxy-ethyl)aniline sulfate 1-hydrate | 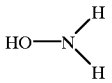 |

TABLES 11 and 12-continued

| Test No. | Solvent | Compound #1 | Amt. (g) | Compound #2 | Compound #3 |
|---|---|---|---|---|---|
| 74 | acetone | 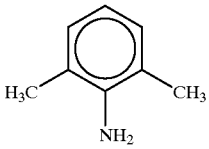 | 0.5 | 4-amino-3-methyl-N-ethyl-N-(-hydroxy-ethyl)aniline sulfate 1-hydrate | 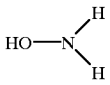 |
| 75 | acetone | 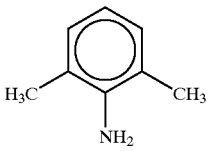 | 0.5 | 4-amino-3-methyl-N-ethyl-N-(-hydroxy-ethyl)aniline sulfate 1-hydrate | 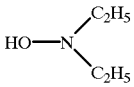 |
| 76 | acetone | 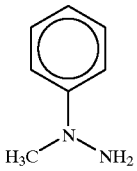 | 0.5 | 4-amino-3-methyl-N-ethyl-N-(-hydroxy-ethyl)aniline sulfate 1-hydrate | 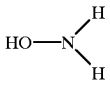 |

Quantities of compounds (2) and (3) according to the invention and organic solvent for each solution were 100 g, 50 g and 50 ml respectively. Further, sulfate and oxalate were respectively used as compounds (II-1) and (II-6) of compounds (3) of the invention. The same organic solvents as those for Example #3 were used.

TABLE 13

| No. | Transmittance of light of 575 nm | No. | Transmittance of light of 575 nm |
|---|---|---|---|
| 65 | >90% | 71 | >90% |
| 66 | >90% | 72 | >90% |
| 67 | >90% | 73 | >90% |
| 68 | >90% | 74 | >90% |
| 69 | >90% | 75 | >90% |
| 70 | >90% | 76 | >90% |

As seen from the above results in Table 13, each and every solid color developing agent composition containing compounds (1), (2) and (3) according to the invention results in a high words the compositions were not tinted. On the other hand, the color developing agent compositions that did not contain a compound (1) according to the invention were tinted to a large extent, resulting in a considerably low transmittance. This proves that a composition of a color developing agent according to the invention has excellent stability.

Example #6

The following color developer and processing solutions were prepared by using the compositions of color developing agents of Example #1 (shown in Tables 1 and 2), Example #2 (shown in Table 3), Example #3 (shown in Tables 4, 5 and 6), Example #4 (shown in Tables 8 and 9), and Example #5 (shown in Tables 11 and 12), all of which had undergone the stability test for the color developing agent. Then, commercially available color paper was exposed to a specified light by means of a photographic sensitometer and then processed under the steps shown in Table 14 below.

TABLE 14

| Process | Temperature | Time |
|---|---|---|
| Color developing | 38° C. ± 0.3° C. | 3 min. 15 sec. |
| Bleaching | 35 to 40° C. | 1 min. |
| Fixing | 35 to 40° C. | 2 min. |
| Washing | 35 to 40° C. | 2 min. |
| Stabilizing | 35 to 40° C. | 1 min. |
| Drying | 40 to 70° C. | |

Color developer solution (A)

| | | |
|---|---|---|
| Potassium carbonate | 35.0 | g |
| Sodium sulfite | 2.5 | g |
| Potassium bromide | 1.3 | g |
| Potassium iodide | 0.002 | g |
| Diethylenetriamine pentaacetic acid | 2.0 | g |
| Color developing agent composition according to the present invention | 30.0 | ml |
| Water: sufficient quantity to bring the total volume of the solution to: | 1.0 | l |
| pH (adjusted with postassium hydroxide) | 10.0 | |

Color developer solution (B)

| | | |
|---|---|---|
| Potassium carbonate | 35.0 | g |
| Sodium sulfite | 2.5 | g |
| Potassium bromide | 1.3 | g |
| Potassium iodide | 0.002 | g |
| Hydroxyamine sulfate (*1) | 0.03 | mol |

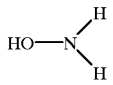

| | | |
|---|---|---|
| 4-amino-3-methyl-N-ethyl-N-(β-hydroxyethyl) aniline sulfate 1-hydrate (*2) | 2.0 | g |
| Water: sufficient quantity to bring the total volume of the solution to: | 1.0 | l |

TABLE 14-continued

| | | |
|---|---|---|
| pH (adjusted with postassium hydroxide) | 10.0 | |
| Bleaching solution | | |
| Ammonium 1,3-diaminopropane iron (III) tetraacetate | 130.0 | g |
| 1,3-diaminopropane tetraacetate | 6.5 | g |
| Ammonium bromide | 100.0 | g |
| Glacial acetic acid | 50.0 | g |
| Hydroxyamine sulfate (*1) | 0.03 | mol |
| 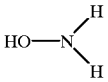 | | |
| Water: sufficient quantity to bring the total volume of the solution to: | 1.0 | l |
| pH (adjusted with ammonium hydroxide) | 4.5 | |
| Fixing solution | | |
| Ammonium thiosulfate | 200.0 | g |
| Sodium hydrogen sulfite | 15.0 | g |
| Disodium ethylenediamine tetraacetate | 0.5 | g |
| Ammonium hydroxide | 3.0 | g |
| Water: sufficient quantity to bring the total volume of the solution to: | 1.0 | l |
| pH (adjusted with acetic acid) | 6.5 | |
| Stabilizing solution | | |
| "Wettol" (a product of Chugai Shasin Yakuhin Co., Ltd.) | 5.0 | ml |
| Formalin (37%) | 1.0 | ml |
| Water: sufficient quantity to bring the total volume of the solution to: | 1.0 | l |

(*1) Compound (3) specified by the invention (Compound (II-1) of formula II)
(*2) Compound (2) specified by the invention (para-phenylene diamine type color developing agent (4))

The respective densities of the minimum density part (Dmin.), the low density part (LD) and the high density part (HD) of the processed photographic materials were measured to deter-mine the difference between the densities of the high density part and the low density part as contrast (HD−LD) and also to find the difference between the result of using color developer solution (B) containing color developing agent which had not undergone the stability test and the result of using developer solution (A) containing color developing agent composition after the stability test, the said difference being determined by measuring the change in the minimum density (ΔDmin), the sensitivity change (ΔLD) and the contrast change (ΔHD−LD). The measurement was made using a transmission density meter ("X-RITE310"). The results are as shown in Tables 14, 15, 16 and 17, wherein ①, ② and ③ respectively represent the blue, green and red color densities.

TABLES 14, 15, 16 and 17

| Test No. | Composition No. (NB) | | ΔD min. | ΔLD | ΔHD − LD |
|---|---|---|---|---|---|
| 101 | 9 | ① | 0.07 | 0.16 | 0.14 |
| | | ② | 0.06 | 0.13 | 0.12 |
| | | ③ | 0.06 | 0.07 | 0.17 |
| 102 | 10 | ① | −0.01 | 0.01 | 0.03 |
| | | ② | −0.01 | 0.00 | 0.02 |
| | | ③ | 0.01 | 0.00 | 0.00 |
| 103 | 11 | ① | −0.01 | 0.02 | 0.02 |
| | | ② | 0.00 | 0.02 | 0.02 |
| | | ③ | 0.01 | 0.01 | 0.02 |
| 104 | 13 | ① | 0.01 | 0.01 | 0.02 |
| | | ② | 0.01 | 0.00 | 0.01 |
| | | ③ | 0.00 | 0.00 | 0.01 |

TABLES 14, 15, 16 and 17-continued

| Test No. | Composition No. (NB) | | ΔD min. | ΔLD | ΔHD − LD |
|---|---|---|---|---|---|
| 105 | 15 | ① | −0.01 | 0.00 | 0.02 |
| | | ② | 0.01 | −0.01 | 0.01 |
| | | ③ | 0.00 | 0.01 | −0.01 |
| 106 | 21 | ① | 0.09 | 0.17 | 0.16 |
| | | ② | 0.05 | 0.15 | 0.16 |
| | | ③ | 0.05 | 0.09 | 0.20 |
| 107 | 22 | ① | 0.01 | 0.00 | 0.02 |
| | | ② | −0.01 | 0.01 | 0.02 |
| | | ③ | 0.00 | 0.00 | 0.01 |
| 108 | 26 | ① | 0.07 | 0.14 | 0.14 |
| | | ② | 0.05 | 0.12 | 0.13 |
| | | ③ | 0.04 | 0.07 | 0.18 |
| 109 | 29 | ① | 0.01 | 0.00 | 0.02 |
| | | ② | 0.00 | 0.00 | 0.01 |
| | | ③ | 0.00 | 0.00 | 0.01 |
| 110 | 34 | ① | 0.01 | 0.00 | 0.02 |
| | | ② | 0.01 | 0.01 | 0.00 |
| | | ③ | 0.00 | 0.00 | 0.01 |
| 111 | 35 | ① | 0.00 | 0.01 | 0.01 |
| | | ② | 0.01 | −0.01 | 0.01 |
| | | ③ | −0.01 | 0.01 | 0.01 |
| 112 | 45 | ① | −0.01 | 0.00 | 0.02 |
| | | ② | 0.00 | −0.01 | 0.00 |
| | | ③ | 0.02 | 0.01 | 0.01 |
| 113 | 52 | ① | 0.10 | 0.13 | 0.19 |
| | | ② | 0.11 | 0.16 | 0.18 |
| | | ③ | 0.08 | 0.13 | 0.20 |
| 114 | 61 | ① | 0.01 | 0.01 | 0.02 |
| | | ② | 0.02 | 0.01 | 0.00 |
| | | ③ | 0.01 | 0.00 | 0.01 |
| 115 | 63 | ① | 0.00 | −0.01 | 0.01 |
| | | ② | 0.00 | 0.01 | 0.02 |
| | | ③ | 0.01 | 0.01 | 0.02 |
| 116 | 68 | ① | 0.00 | 0.01 | 0.02 |
| | | ② | 0.00 | −0.01 | 0.01 |
| | | ③ | 0.00 | 0.00 | 0.01 |
| 117 | 76 | ① | 0.00 | 0.01 | 0.01 |
| | | ② | 0.01 | 0.00 | 0.02 |
| | | ③ | 0.02 | 0.00 | 0.02 |

The color developing agent composition No. is found in Tables 1, 2, 3, 4, 5, 6, 8, 9, 11 and 12.

As is seen from the above results, Test Nos. 102, 103, 104, 105, 107, 109, 110, 111, 112, 114, 115, 116 and 117 wherein color developing agent compositions containing compounds (1) of the present invention were used show no difference in their results from those using color developing agents before the stability test. In contrast to this, Test Nos. 101, 106, 108 and 113 wherein color developing agent compositions which do not containing a compound (1) of the present invention were used show great difference in their results with those of using color developing agents before the stability test, in other words showing a marked deterioration in quality. Therefore, it is evident that using compounds according to the present invention improves stability of a color developing agent composition.

Example #7

The following color developer and processing solutions were prepared by using the compositions of color developing agents of Example #1 (shown in Tables 1 and 2), Example #2 (shown in Table 3), Example #3 (shown in Tables 4, 5 and 6), Example #4 (shown in Tables 8 and 9), and Example #5 (shown in Tables 11 and 12), all of which had undergone the stability test for the color developing agent. Then, commercially available color paper was exposed to a specified light by means of a photographic sensitometer and then processed under the steps shown in Table 18 below.

TABLE 18

| Process | Temperature | Time |
|---|---|---|
| Color developing | 38° C. ± 0.3° C. | 45 sec. |
| Bleaching & fixing | 35° C. | 45 sec. |
| Rinsing | 35° C. | 90 sec. |
| Drying | 70 to 90° C. | |

| Color developer solution (C) | | |
|---|---|---|
| Triethanolamine | 8.0 | g |
| Sodium chloride | 2.0 | g |
| Potassium carbonate | 25.0 | g |
| Diethylenetriamine pentaacetic acid | 1.0 | g |
| Sodium sulfite | 0.02 | g |
| Optical whetening agent (UVITEX MST by CIBA-GEIGY | 5.0 | g |
| Color developing agent composition according to the invention | 9.0 | g |
| Water: sufficient quantity to bring the total volume of the solution to: | 1.0 | l |
| pH (adjusted with postassium hydroxide) | 10.0 | |
| **Color developer solution (D)** | | |
| Triethanolamine | 8.0 | g |
| Sodium chloride | 2.0 | g |
| Potassium carbonate | 25.0 | g |
| Diethylenetriamine pentaacetic acid | 1.0 | g |
| Sodium sulfite | 0.02 | g |
| Optical whitening agent (UVITEX MST by CIBA-GEIGY) | 5.0 | g |
| Diethylhydroxylamine (*3) | 3.0 | g |

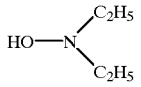

| | | |
|---|---|---|
| 4-amino-3-methyl-N-ethyl-N-β-methylsulfonamide ethyl)aniline 3/2-sulfate 1-hydrate (*4) | 6.0 | g |
| Water: sufficient quantity to bring the total volume of the solution to: | 1.0 | l |
| pH (adjusted with postassium hydroxide) | 10.0 | |
| **Bleaching-fixing solution** | | |
| Ammonium thiosulfate | 90.0 | g |
| Ammonium sulfite | 35.0 | g |
| Ammonium ethylenediamine iron (III) tetraacetate | 60.0 | g |
| Ethylenediamine tetraacetate | 6.0 | g |
| Water: sufficient quantity to bring the total volume of the solution to: | 1.0 | l |
| pH (adjusted with ammonium hydroxide) | 6.5 | |
| **Rinsing solution** | | |
| 1-Hydroxyalkylidene-1,1-diphosphonic acid | 4.5 | g |
| 2-Aminobenzothiazol | 0.1 | g |
| Water: sufficient quantity to bring the total volume of the solution to: | 1.0 | l |
| pH (adjusted with sodium hydroxide) | 6.5 | |

(*3) Compound (3) specified by the invention (Compound (II-6) of formula II)
(*4) Compound (2) specified by the invention (p-phenylene diamine type color developing agent (3))

The respective densities of the minimum density part (Dmin.), the low density part (LD) and the high density part (HD) of the processed photographic materials were measured to determine the difference between the densities of the high density part and the low density part as contrast (HD−LD) and also to find the difference between the result of using color developer solution (B) containing color developing agent which had not undergone the stability test and the result of using developer solution (A) containing color developing agent composition after the stability test, the said difference being determined by measuring the change in the minimum density (ΔDmin), the sensitivity change (ΔLD) and the contrast change (ΔHD−LD). The measurement was made using a reflecting density meter ("X-RITE310"). The results are as shown in Tables 19, 20 and 21, wherein ①, ② and ③ a respectively represent the blue, green and red color densities.

TABLES 19, 20 and 21

| Test No. | Composition No. (NB) | | ΔD min. | ΔLD | ΔHD − LD |
|---|---|---|---|---|---|
| 118 | 18 | ① | 0.05 | 0.03 | −0.14 |
| | | ② | 0.06 | 0.01 | −0.14 |
| | | ③ | 0.08 | 0.01 | −0.20 |
| 119 | 19 | ① | 0.01 | 0.01 | −0.01 |
| | | ② | 0.01 | 0.00 | −0.02 |
| | | ③ | 0.01 | 0.01 | −0.04 |
| 120 | 25 | ① | 0.04 | 0.03 | −0.08 |
| | | ② | 0.04 | 0.01 | −0.12 |
| | | ③ | 0.06 | 0.02 | −0.24 |
| 121 | 38 | ① | 0.01 | 0.00 | 0.01 |
| | | ② | 0.00 | 0.01 | 0.01 |
| | | ③ | 0.00 | 0.01 | 0.01 |
| 122 | 41 | ① | 0.00 | 0.01 | 0.02 |
| | | ② | −0.01 | 0.00 | 0.00 |
| | | ③ | 0.00 | 0.00 | 0.00 |
| 123 | 49 | ① | 0.00 | 0.00 | 0.00 |
| | | ② | 0.01 | 0.00 | 0.01 |
| | | ③ | 0.01 | 0.01 | −0.01 |
| 124 | 51 | ① | 0.05 | 0.02 | −0.10 |
| | | ② | 0.07 | 0.03 | −0.14 |
| | | ③ | 0.08 | 0.01 | −0.19 |
| 125 | 54 | ① | 0.01 | −0.01 | 0.01 |
| | | ② | 0.01 | 0.01 | 0.01 |
| | | ③ | 0.00 | 0.01 | 0.00 |
| 126 | 64 | ① | 0.01 | 0.00 | 0.02 |
| | | ② | 0.02 | 0.01 | 0.00 |
| | | ③ | 0.00 | 0.00 | 0.01 |
| 127 | 72 | ① | 0.00 | −0.01 | 0.00 |
| | | ② | −0.01 | 0.01 | 0.01 |
| | | ③ | 0.00 | 0.01 | 0.01 |
| 128 | 75 | ① | 0.00 | 0.01 | 0.01 |
| | | ② | 0.00 | 0.01 | 0.00 |
| | | ③ | −0.01 | 0.02 | 0.02 |

The color developing agent composition Nos. are as found in Tables 1, 2, 3, 4, 5, 6, 8, 9, 11 and 12.

As is seen from the above results, Test Nos. 119, 121, 122, 123, 125, 126, 127 and 128 wherein color developing agent compositions containing compounds (1) of the present invention were used show no difference in their results with those of using color developing agents before the stability test. In contrast to this, Test Nos. 118, 120 and 124 wherein color developing agent compositions which do not containing a compound (1) of the present invention were used show great difference in their results with those of using color developing agents before the stability test, in other words showing a marked deterioration in quality. Therefore, it is evident that using compounds according to the present invention improves stability of a color developing agent composition.

Discussion

Therefore, what has been shown is a color developing agent composition comprising:

(1) a compound given by formula (I)

(I)

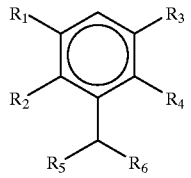

wherein $R_1$, through $R_6$ are substituents respectively and independently are selected from the group consisting of a hydrogen atom, an alkyl group, an alkoxyl group, a hydroxyl group and an amino group, and substituted derivatives thereof, wherein the substitutents are selected from the group consisting of a hydroxyl group, an amino group and an alkoxyl group;

(2) a paraphenylene diamine type color developing agent; and (3) a compound given by Formula (II)

(II)

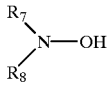

wherein $R_7$ and $R_8$ are substituents respectively and independently selected from the group consisting of a hydrogen atom, an alkyl group and a substituted alkyl group.

The color developing agent composition may be a liquid or it may be a solid. In a more preferred embodiment of the invention, the color developing agent composition comprises:

(1) a compound given by formula (I)

(I)

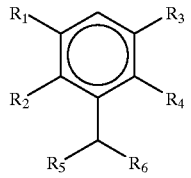

wherein $R_1$ through $R_4$ are substituents respectively and independently are selected from the group consisting of H, $C_1$–$C_4$ alkyls, and $OR_9$ wherein $R_9$ is selected from the group consisting of H and $C_1$–$C_4$ alkyls;

$R_5$ through $R_6$ are substitutents respectively and independently are selected from the group consisting of H, $C_1$–$C_4$ alkyls, $OR_9$ and $N(R_{10})_2$ wherein $R_9$ is selected from the group consisting of H and $C_1$–$C_4$ alkyls, $R_{10}$ is selected from the group consisting of H and $C_1$–$C_2$ alkyls;

(2) a paraphenylene diamine type color developing agent; and (3) a compound given by Formula (II)

(II)

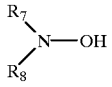

wherein $R_7$ and $R_8$ are substituents respectively and independently selected from the group consisting of H, $C_1$–$C_4$ alkyls, $OR_{11}$, $R_{12}$-A-$R_{13}$ and $C_2$–$C_4$ alkenyls, wherein $R_{11}$ is selected from the group consisting of $C_1$–$C_2$ alkyls, $R_{12}$ is selected from the group consisting of $C_1$–$C_2$ alkyls, A is selected from the group consisting of H, $SO_3$, $PO_3$ and $CO_2$, and $R_{13}$ is selected from the group consisting of H, $H_2$, $C_1$–$C_2$ alkyls in an amount sufficient to satisfy A; and further wherein $R_7$ and $R_8$ may be bonded together.

What is claimed is:

1. A color developing agent composition comprising:

(a) a compound given by formula (I)

(I)

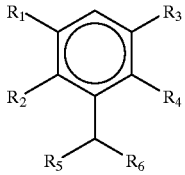

wherein $R_2$ through $R_6$ are substituents respectively and independently are selected from the group consisting of a hydrogen atom, an alkyl group, a hydroxyl group and an amino group, and substituted derivatives thereof, wherein the substituents are selected from the group consisting of a hydroxyl group and an amino group;

(b) a paraphenylene diamine type color developing agent; and (c) a compound given by Formula (II)

(II)

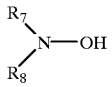

wherein $R_7$ and $R_8$ are substituents respectively and independently selected from the group consisting of a hydrogen atom, an alkyl group and a substituted alkyl group;

wherein said composition is acidic.

2. A color developing agent composition according to claim 1 wherein the composition is a liquid.

3. A color developing agent composition according to claim 1 wherein the composition is a solid.

4. A color developing agent composition according to claim 1 wherein:

(a) said compound of formula (I) is a compound wherein $R_1$ through $R_4$ are substituents respectively and independently selected from the group consisting of H and $C_1$–$C_4$ alkyls $R_5$ through $R_6$ are substituents respectively and independently selected from the group consisting of H, $C_1$–$C_4$ alkyls, $OR_9$ and $N(R_{10})_2$ wherein $R_9$ is selected from the group consisting of H and $C_1$–$C_4$ alkyls, $R_{10}$ is selected from the group consisting of H and $C_1$–$C_2$ alkyls; and (b) said compound of formula (II) is a compound wherein $R_7$ and $R_8$ are substituents respectively and independently selected from the group consisting of H, $C_1$–$C_4$ alkyls, $OR_{11}$, $R_{12}$-A-$R_{13}$ and $C_2$–$C_4$ alkenyls, wherein $R_{11}$ is selected from the group consisting of $C_1$–$C_2$ alkyls, $R_{12}$ is selected from the group consisting of $C_1$–$C_2$ alkyls, A is selected from the group consisting of H, $SO_3$, $PO_3$ and $CO_2$, and $R_{13}$ is selected from the group consisting of H, $H_2$, $C_1$–$C_2$ alkyls in an amount sufficient to satisfy A; and further wherein $R_7$ and $R_8$ may be bonded together.

5. A color developing agent composition according to claim 4 wherein formula (I) is selected from the group consisting of

| Cpd | Formula |
|---|---|
| I-1 | 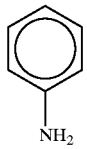 |
| I-2 | 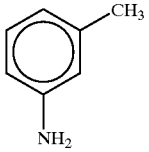 |
| I-3 | 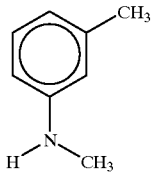 |
| I-4 | 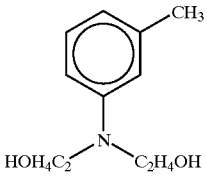 |

-continued

| Cpd | Formula |
|---|---|
| I-5 | 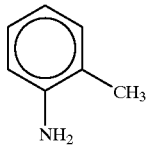 |
| I-6 | 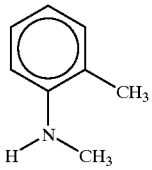 |
| I-7 | 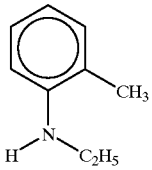 |
| I-8 | 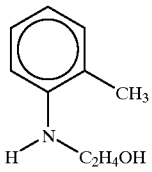 |
| I-9 | 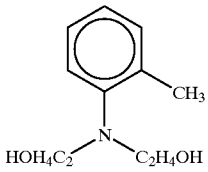 |
| I-10 | 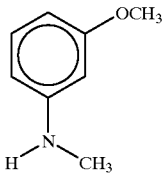 |
| I-15 | 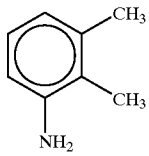 |
| I-16 | 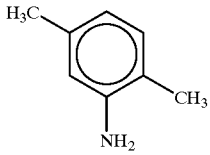 |

-continued
| Cpd | Formula |
|---|---|
| I-17 | 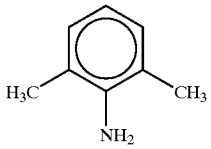 |
| I-18 | 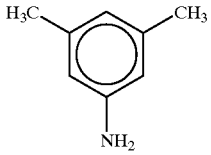 |
| I-19 | 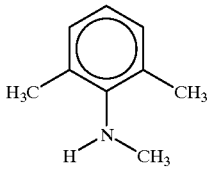 |
| I-20 | 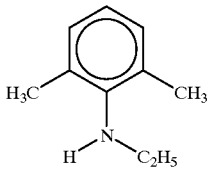 |
| I-21 | 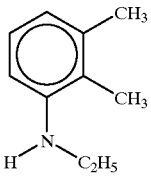 |
| I-22 | 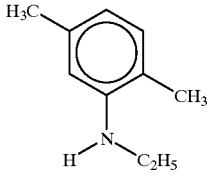 |
| I-23 | 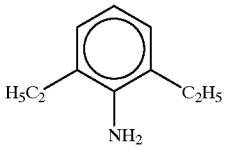 |
| I-24 | 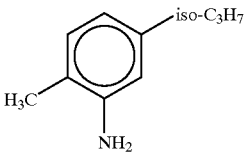 |
-continued
| Cpd | Formula |
|---|---|
| I-25 | 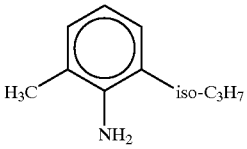 |
| I-26 | 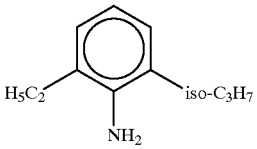 |
| I-27 | 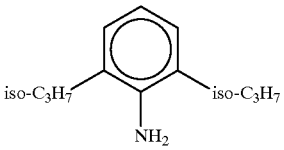 |
| I-28 | 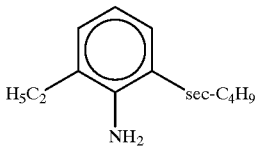 |
| I-29 | 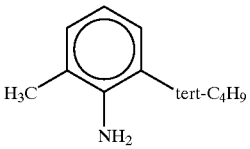 |
| I-30 | 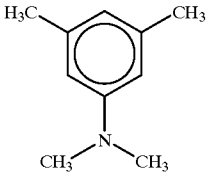 |
| I-31 | 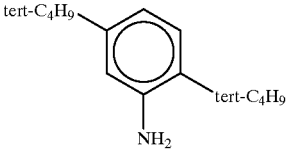 |
| I-32 | 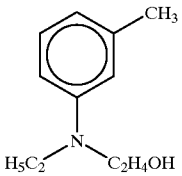 |

-continued

| Cpd | Formula |
|---|---|
| I-33 | 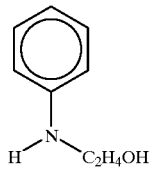 |
| I-34 | 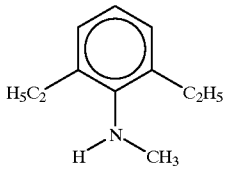 |
| I-35 | 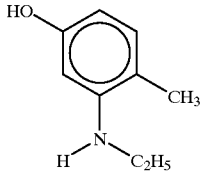 |
| I-36 | 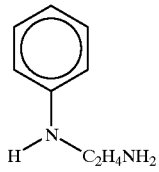 |
| I-37 | 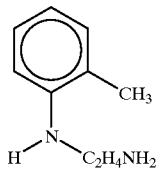 |
| I-38 | 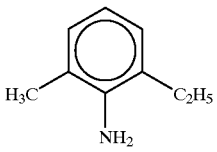 |
| I-39 | 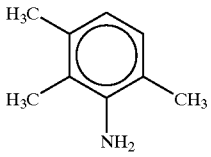 |
| I-40 | 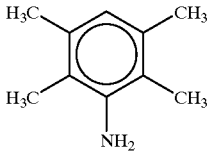 |

-continued

| Cpd | Formula |
|---|---|
| I-41 | 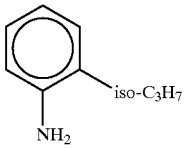 |
| I-42 | 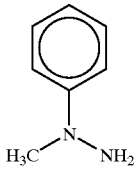 |
| I-43 | 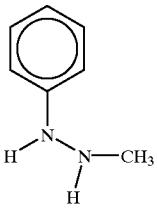 |
| I-44 | 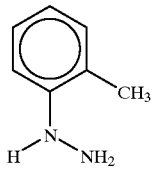 |
| and | |
| I-45 | 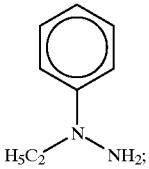 |

wherein the para-phenylene diamine is selected from the group consisting of 4-amino-3-methyl-N-diethyl aniline hydrochloride, 4-amino-N-ethyl-N-(-hydroxyethyl) aniline sulfate, 4-amino-3-methyl-N-ethyl-N-(-methylsulfonamide ethyl) aniline 3/2-sulfate 1-hydrate, 4-amino-3-methyl-N-ethyl-N-(-hydroxyethyl) aniline sulfate 1-hydrate, 4-amino-3-(-methylsulfonamide ethyl)-N-diethyl aniline hydrochloride, 4-amino-N-ethyl-N-(-methoxyethyl) aniline 2-paratoluene sulfonate, and 4-amino-N-butyl-N-(-butylsulfonate) aniline sulfate; and wherein the compounds of formula (II) are selected from the group consisting of

| Cpd | Formula |
|---|---|
| II-1 | 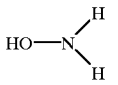 |
| II-2 | 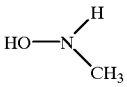 |
| II-3 | 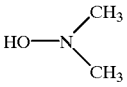 |
| II-4 | 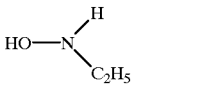 |
| II-5 | 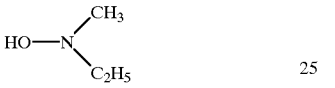 |
| II-6 | 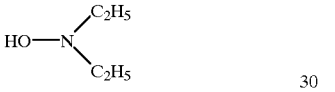 |
| II-7 | 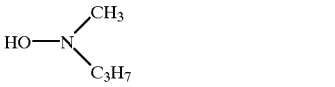 |
| II-8 | 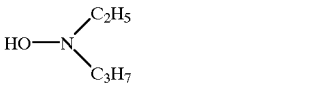 |
| II-9 | 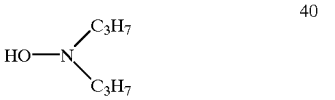 |
| II-10 | 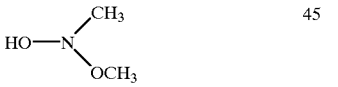 |
| II-11 | 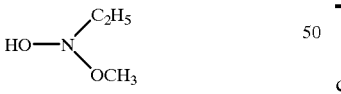 |
| II-12 | 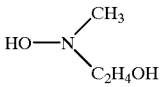 |
| II-13 | 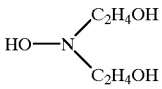 |
| II-14 | 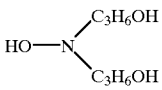 |

-continued

| Cpd | Formula |
|---|---|
| II-15 | 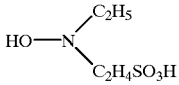 |
| II-16 | 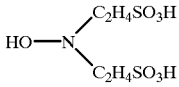 |
| II-17 | 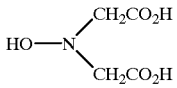 |
| II-18 | 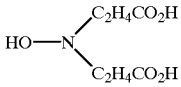 |
| II-19 | 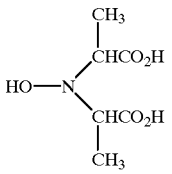 |
| II-20 | 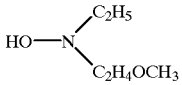 |
| II-21 | 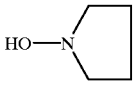 |
| II-22 | 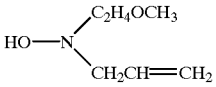 |
| and | |
| II-23 | 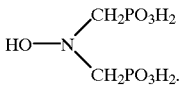 |

6. A color developing agent composition according to claim 4 wherein:

said compound (I) is selected from the group consisting of I-3, I-6, I-7, I-8, I-15, I-16, I-17, I-18, I-19, I-20, I-21, I-22, I-23, I-27, I-32,I-42, I-43, I-44, and I-45;

said paraphenylene diamine compound selected from the group consisting of 4-amino-3-methyl-N-ethyl-N-(-hydroxy-ethyl) aniline sulfate 1-hydrate 4-amino-3-methyl-N-ethyl-N-(-methylsulfonamide ethyl) aniline 3/2 sulfate 1-hydrate; and said compound (II) is selected from the group consisting of II-1, II-2, II-6 and II-16.

7. A color developing agent composition according to claim 1 wherein (1) said compound of formula (I) is

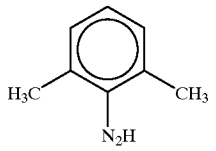

(2) said paraphenylene diamine color developing agent is 4-amino-3-methyl-N-ethyl-N-(-hydroxy-ethyl) aniline sulfate 1-hydrate, and (3) said compound given by formula (II) is hydroxylamine.

8. A color developing agent composition according to claim 1 wherein said color developing agent composition has a transmittance of 575 nm light of more than 90%.

9. A color developing agent composition according to claim 1 wherein said color developing agent composition is a precursor for a color developer solution.

10. A color developing agent composition according to claim 1 wherein said color development agent composition has a pH not over 5.

* * * * *